US009093244B2

(12) United States Patent
Han et al.

(10) Patent No.: US 9,093,244 B2
(45) Date of Patent: Jul. 28, 2015

(54) METHOD FOR ROUTING GAMMA VOLTAGES IN FLAT PANEL DISPLAY

(71) Applicant: SILICON WORKS CO., LTD, Daejeon-si (KR)

(72) Inventors: Dae-Keun Han, Daejeon-si (KR); Dae-Seong Kim, Daejeon-si (KR); Joon-Ho Na, Daejeon-si (KR); Hong-Hee Son, Daejeon-si (KR); Hyun-Ho Cho, Incheon-si (KR); Hyung-Seog Oh, Cheongju-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 298 days.

(21) Appl. No.: 13/798,216

(22) Filed: Mar. 13, 2013

(65) Prior Publication Data

US 2013/0244529 A1 Sep. 19, 2013

Related U.S. Application Data

(63) Continuation-in-part of application No. 12/594,794, filed as application No. PCT/KR2008/001672 on Mar. 26, 2008, now abandoned.

(51) Int. Cl.
*H01J 9/44* (2006.01)
*G09G 3/20* (2006.01)

(52) U.S. Cl.
CPC ... *H01J 9/44* (2013.01); *G09G 3/20* (2013.01); *G09G 2320/041* (2013.01); *G09G 2330/028* (2013.01)

(58) Field of Classification Search
CPC ..... H01J 9/025; H01J 31/123; H01J 1/304
See application file for complete search history.

(56) References Cited

U.S. PATENT DOCUMENTS

| | | | |
|---|---|---|---|
| 2005/0007334 | A1 | 1/2005 | Park |
| 2005/0057482 | A1 | 3/2005 | Youngblood et al. |
| 2005/0068332 | A1 | 3/2005 | Diefenbaugh et al. |
| 2005/0093797 | A1 | 5/2005 | Sung et al. |

FOREIGN PATENT DOCUMENTS

| | | |
|---|---|---|
| CN | 1728227 | 2/2006 |
| CN | 1928959 | 3/2007 |
| JP | 8-76726 | 3/1996 |
| JP | 11-175027 | 7/1999 |
| JP | 2002-366112 | 12/2002 |
| JP | 2004-354625 | 12/2004 |
| JP | 2006-146134 | 6/2006 |
| KR | 10-0589566 | 6/2004 |
| KR | 10-2006-0054134 | 5/2006 |

*Primary Examiner* — Elmito Breval

(74) *Attorney, Agent, or Firm* — Kile Park Reed & Houtteman PLLC

(57) ABSTRACT

A method for routing gamma voltages in a flat panel display that includes a plurality of source driver integrated circuits (SDICs) each having a plurality of gamma buffers. The method includes forming routing lines to route a plurality of gamma voltages; connecting the routing lines to output terminals of the gamma buffers; applying the reset gamma voltage to the gamma buffer of selected SDIC after selecting the SDIC in which the gamma voltage is required to be reset in consideration of heating values of the SDICs, and changing connection between a routing line corresponding to the selected gamma buffer and a tap point of a resistor string of the SDIC such that the connection corresponds to the reset gamma voltage.

8 Claims, 18 Drawing Sheets

METHOD FOR ROUTING GAMMA VOLTAGES IN FLAT PANEL DISPLAY

CROSS REFERENCE TO RELATED APPLICATIONS

This is a continuation-in-part of U.S. patent application Ser. No. 12/594,794, filed Oct. 5, 2009, which is a national entry of International Application No. PCT/KR2008/001672, filed on Mar. 26, 2008, which claims priority to Korean Application No. 10-2007-0036721 filed on Apr. 16, 2007, the entire contents of which are incorporated herein by reference.

BACKGROUND OF THE INVENTION

1. Field of the Invention

The present invention relates to a flat panel display, and more particularly, to a method for routing gamma voltages.

2. Description of the Related Art

A camera converts an image signal into an electrical signal, and a display restores the electrical signal converted by the camera to the original image signal. The display needs correction such that the electrical signal is restored close to the original image signal.

The human eyes have a response characteristic in a log curve shape with respect to incident light, in order to receive brightness of light in a wide range. However, an image sensor mounted in a camera may receive brightness of in a limited dynamic range. A complementary metal oxide semiconductor (CMOS) image sensor may be designed to increase a gain, in order to clearly represent a dark portion. In this case, a saturation phenomenon may occur in some bright portions.

Gamma correction means a function of changing brightness or luminance and is used to correct the nonlinearity of photoelectric conversion characteristics of an image device and the saturation phenomenon of light. A mathematical expression applied to the gamma correction may be represented by a curve, and the curve is called a gamma curve. When a gamma value is set to a high value, a center portion of the gamma curve is lifted, so that the screen becomes brighter. When the gamma value is set to a low value, the center portion of the gamma curve is lowered, so that the screen becomes darker.

The flat panel display may include liquid crystal displays (LCDs) or plasma display panels (PDPs). Recently, flat panel displays using organic light emitting devices (OLEDs) have been developed.

In general, the flat panel display includes six to eight source driver integrated circuits (SDICs). Each of the SDICs includes two gamma buffers configured to buffer gamma voltages.

The gamma buffers may be arranged in a predetermined order during design, according to the levels of gamma voltages or gray levels. The voltages output from the respective gamma buffers are transmitted to a resistor string. The resistor string includes 255 resistors connected in series, for example, and voltages dropped by the respective resistors exhibit characteristics of the gamma curve.

In this case, due to the voltages buffered by the gamma buffers and the resistances of the resistors connected to the gamma buffers so as to operate as loads, power consumptions of the gamma buffers may differ from each other. Since the power consumptions of the gamma buffers are not equal, the heating values or temperatures of the gamma buffers may also differ from each other.

Referring to FIG. 1, each of two source printed circuit boards (S-PCBs) 120 and 130 includes three SDICs. That is, FIG. 1 illustrates six SDICs IC#1 to IC#6 arranged in the two S-PCBs 120 and 130. Referring to FIG. 3, the temperatures of the SDICs IC#1 to IC#6 are 50.5° C., 61.0° C., 51.0° C., 52.0° C., 53.0° C., and 55.6° C., respectively.

Furthermore, each of the SDICs IC#1 to IC#6 includes two gamma buffers. That is, FIG. 1 includes total 12 gamma buffers GB11, GB12, GB21, GB22, GB31, GB32, GB41, GB42, GB51, GB52, GB61, and GB62. Referring to FIG. 4, power consumptions of the gamma buffers GB11 and GB12 to buffer gamma voltages VH255 and VL255 are 11.9 mW and 3.5 mW, respectively, and the sum of the power consumptions is 15.4 mW. Power consumptions of the gamma buffers GB21 and GB22 to buffer gamma voltages VH254 and VL254 are 87.2 mW and 82.7 mW, respectively, and the sum of the power consumptions is 169.8 mW. Power consumptions of the gamma buffers GB31 and GB32 to buffer gamma voltages VH191 and VL191 are 14.0 mW and 10.9 mW, respectively, and the sum of the power consumptions is 24.9 mW. Power consumptions of the gamma buffers GB41 and GB42 to buffer gamma voltages VH127 and VL127 are 11.7 mW and 10.5 mW, respectively, and the sum of the power consumptions is 22.1 mW. Power consumptions of the gamma buffers GB51 and GB52 to buffer gamma voltages VH31 and VL31 are 15.7 mW and 14.4 mW, respectively, and the sum of the power consumptions is 30.1 mW. Power consumptions of the gamma buffers GB61 and GB62 to buffer gamma voltages VH00 and VL00 are 43.5 mW and 42.7 mW, respectively, and the sum of the power consumptions is 86.2 mW.

A center PCB (C-PCB) 110 provides a routing path between the S-PCBs 120 and 130.

Here, VL represents a voltage from the lowest voltage of a gamma voltage to a medium voltage of the gamma voltage, and VH represents a voltage from the medium voltage of the gamma voltage to the highest voltage of the gamma voltage. When the gamma voltage is 12V, VL represents a voltage of 0V to 5.9V, and VH represents a voltage of 6.1V to 12V. For example, VL255 represents 0V, and VL00 represents a voltage 5.9V. Furthermore, VH00 represents 6.1V, and VH255 represents 12V.

Due to the differences in power consumption among the gamma buffers included in the respective SDICs IC#1 to IC#6 as illustrated in FIG. 4, the temperatures of the SDICs IC#2 and IC#6 are higher than the other SDICs as indicated by dotted lines of FIG. 3.

The lifetime and reliability of the flat panel display are decided by the lifetimes and reliabilities of the respective SDICs. When the temperature of a specific SDIC among six or eight SDICs is higher than the other SDICs, the lifetime and reliability of the high-temperature SDIC are inevitably decreased, compared to those of the other SDICs. When a defect occurs in any one of SDICs mounted in a flat panel display, the flat panel display does not operate.

Therefore, in order to improve the lifetime and reliability of the flat panel display, the lifetime and reliability of a specific SDIC must be prevented from being reduced and degraded in comparison with those of the other SDICs.

SUMMARY OF THE INVENTION

Accordingly, the present invention has been made in an effort to solve the problems occurring in the related art, and an object of the present invention is to provide a method for routing gamma voltages, which is capable of reducing temperatures of source driver integrated circuits (SDIC) mounted in a flat panel display and reducing temperature differences among the SDIC.

In order to achieve the above object, according to one aspect of the present invention, there is provided a method for routing gamma voltages in a flat panel display that includes a plurality of SDICs each having a plurality of gamma buffers. The method includes: forming routing lines to route a plurality of gamma voltages; connecting the routing lines to output terminals of the gamma buffers; applying the reset gamma voltage to the gamma buffer of a selected SDIC after selecting the SDIC in which the gamma voltage is required to be reset in consideration of heating values of the SDICs; and changing connection between a routing line corresponding to the selected gamma buffer and a tap point of a resistor string of the SDIC such that the connection corresponds to the reset gamma voltage.

According to another aspect of the present invention, there is provided a method for routing gamma voltages in a flat panel display that includes a plurality of SDICs each having a plurality of gamma buffers. The method includes: forming routing lines to route a plurality of gamma voltages; and, exchanging positions to which a pair of selected gamma voltages are applied and transmitting the pair of selected gamma voltages to the routing lines at the exchanged positions after selecting the pair of gamma voltages to be applied to different SDICs in consideration of heating values of the gamma buffers.

According to another aspect of the present invention, there is provided a method for routing gamma voltages in a flat panel display that includes a plurality of SDICs each having a plurality of gamma buffers. The method includes: mounting one or more external gamma buffers outside the plurality of SDICs; forming routing lines to route a plurality of gamma voltages; changing input of the gamma voltage for a selected gamma buffer and connection between the selected gamma buffer and the routing line to the external gamma buffers after selecting one or more the gamma buffers in consideration of heating values of the gamma buffers; and floating the selected gamma buffers.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
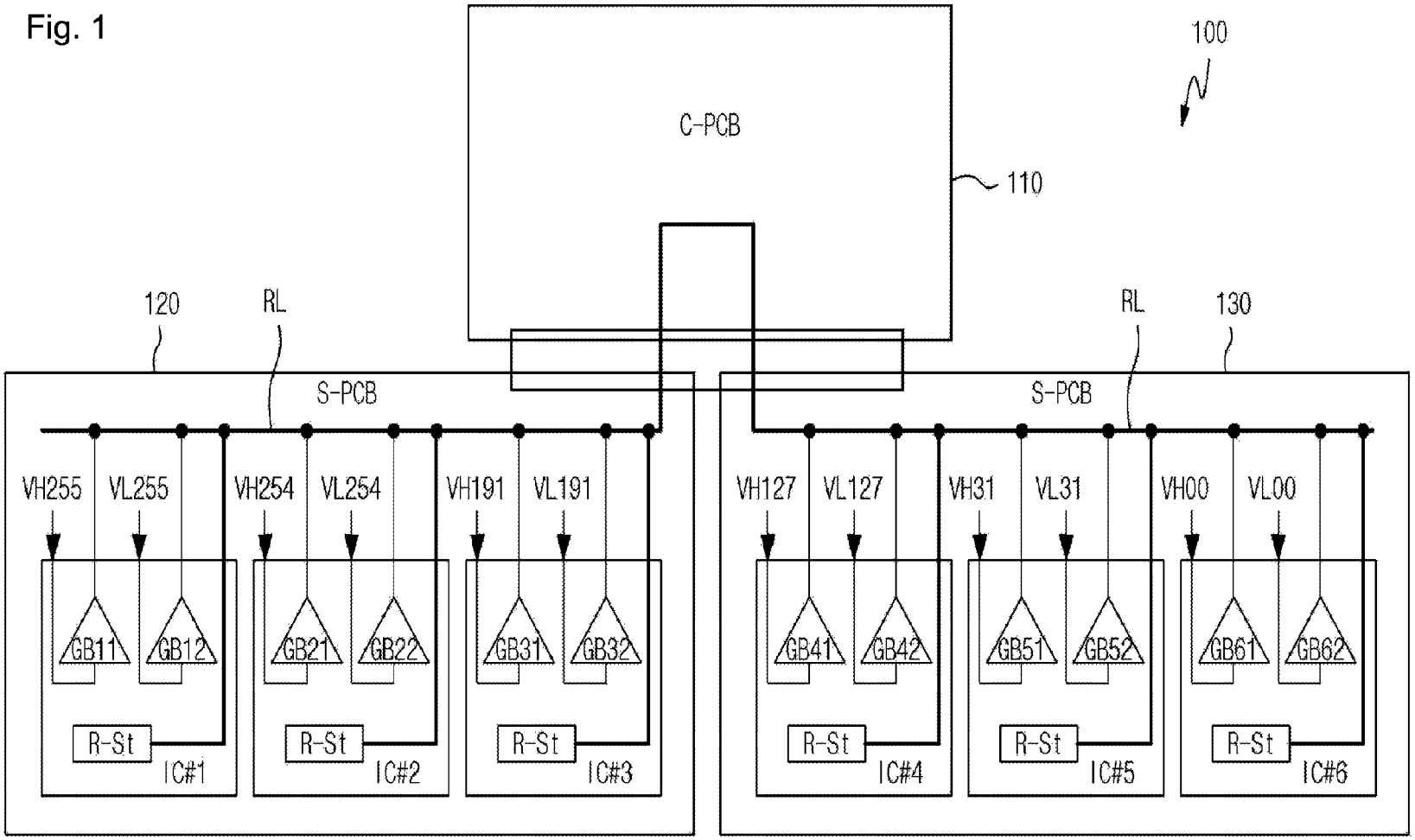
FIG. 1 is an arrangement diagram illustrating a state in which gamma buffers are arranged in a conventional source driver integrated circuit (SDIC)
Figure 2:
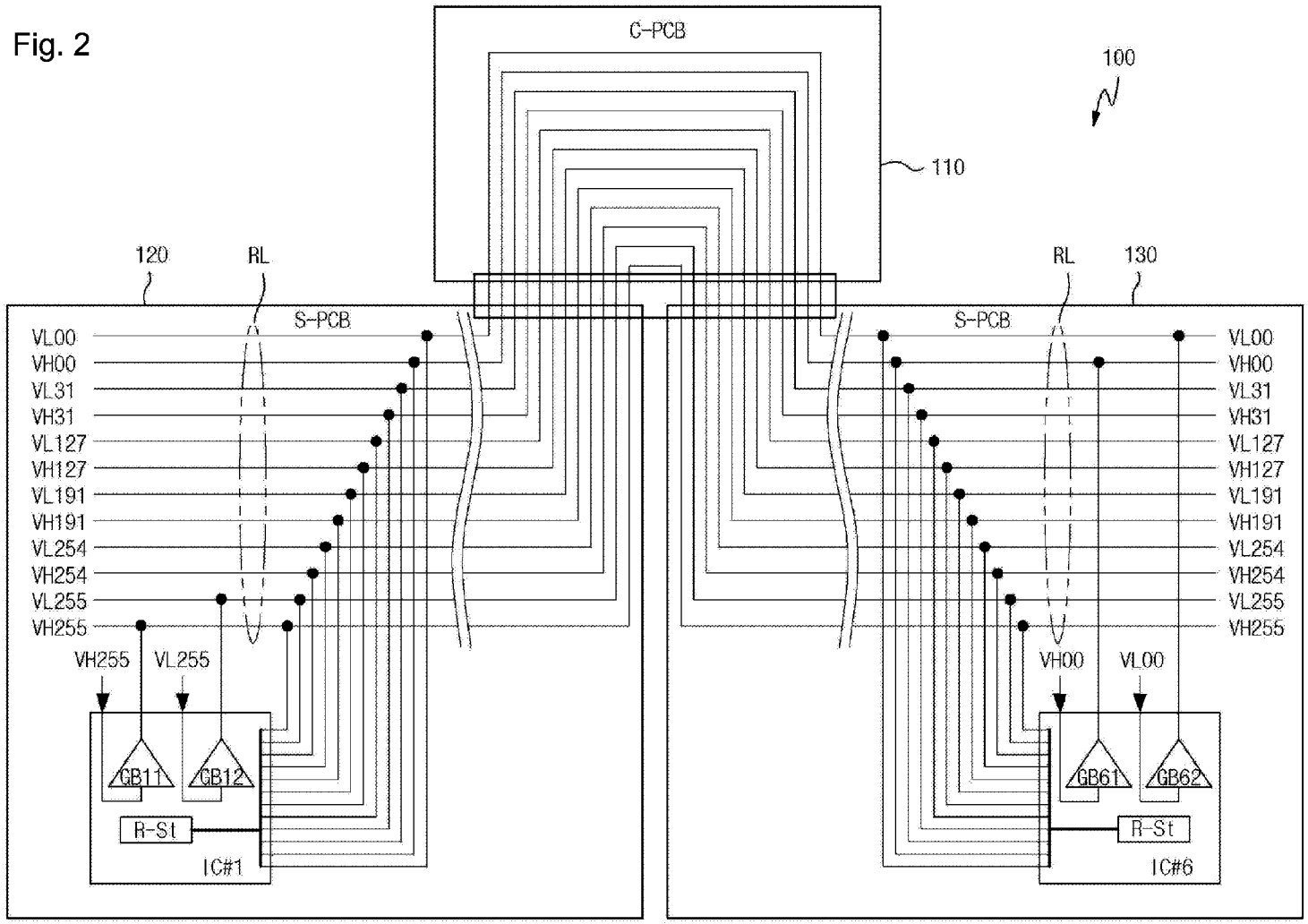
FIG. 2 is a partial detailed arrangement diagram of FIG. 2.
Figure 3:
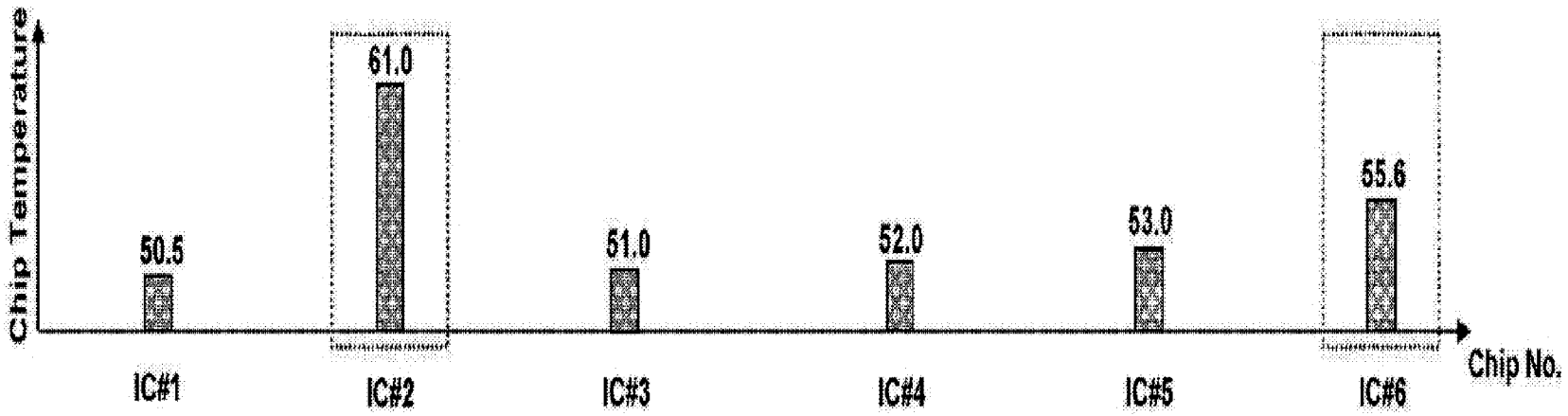
FIG. 3 is a graph illustrating the temperatures of the SDICs of FIG. 1.
Figure 4:
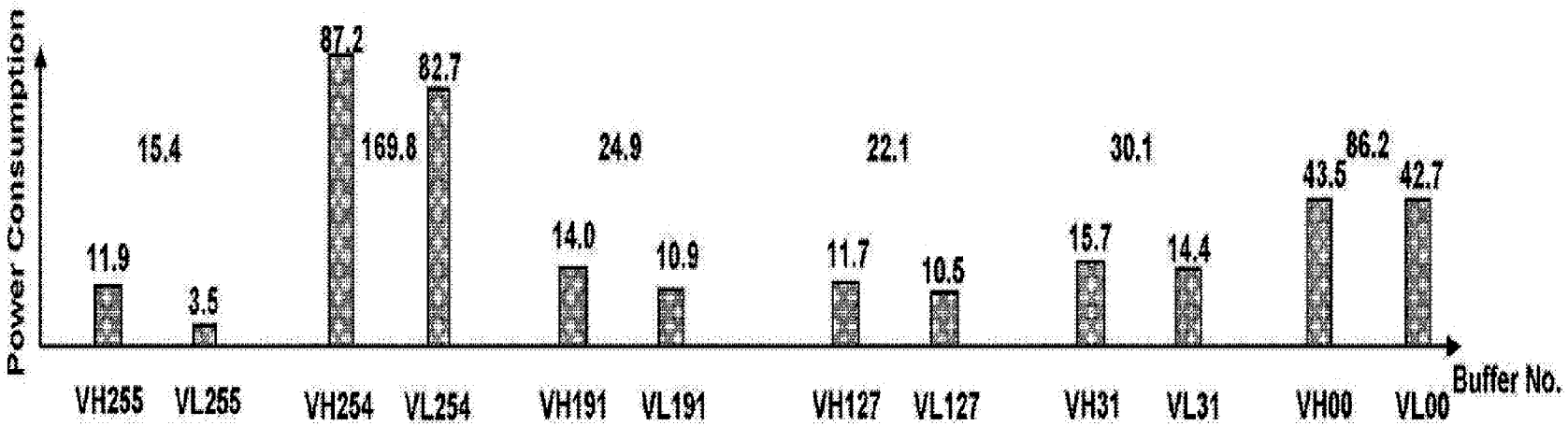
FIG. 4 is a graph illustrating power consumptions of the gamma buffers of FIG. 1.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 5:
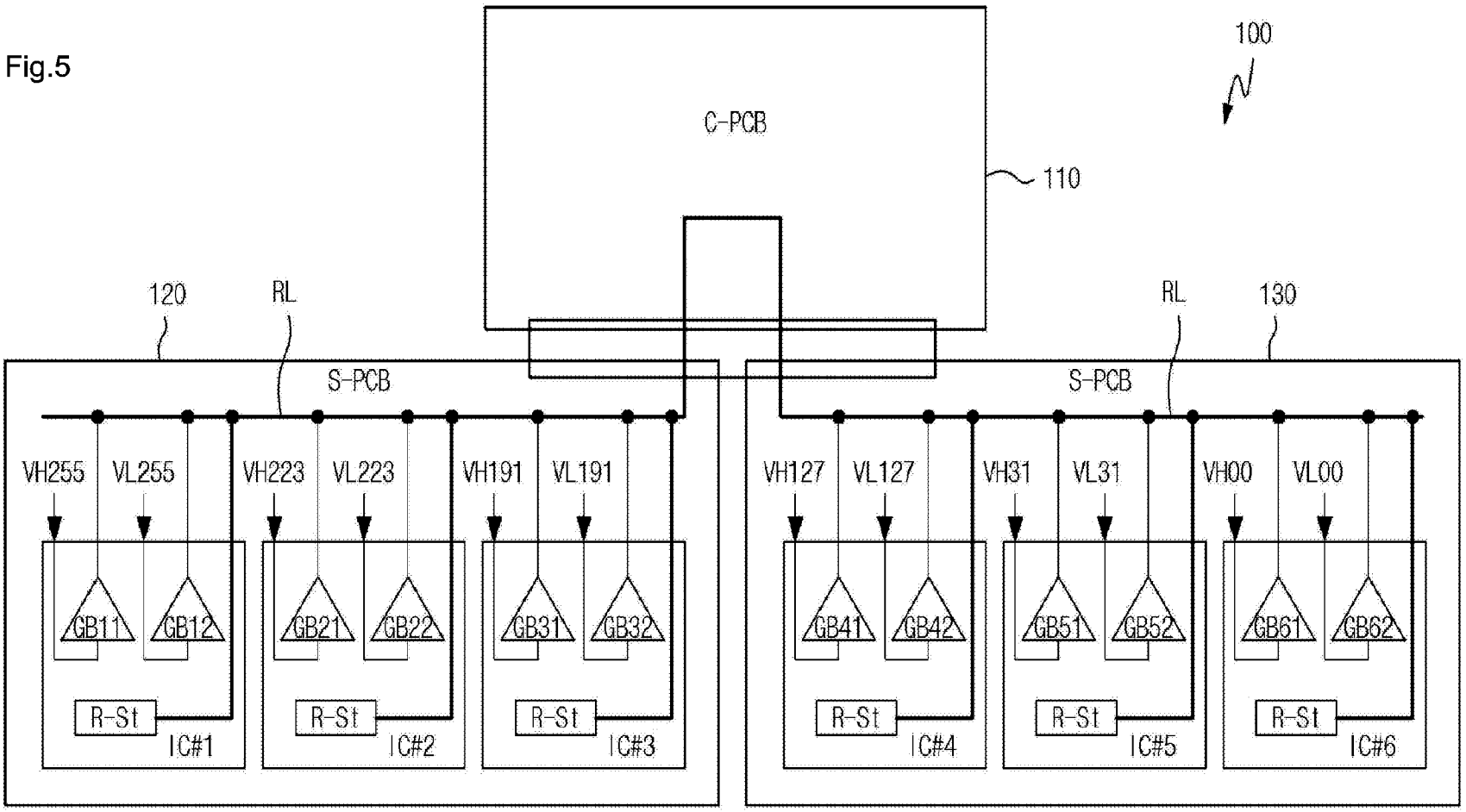
FIG. 5 is an arrangement diagram for explaining a method for routing gamma voltages of a flat panel display according to an embodiment of the present invention.
Figure 6:
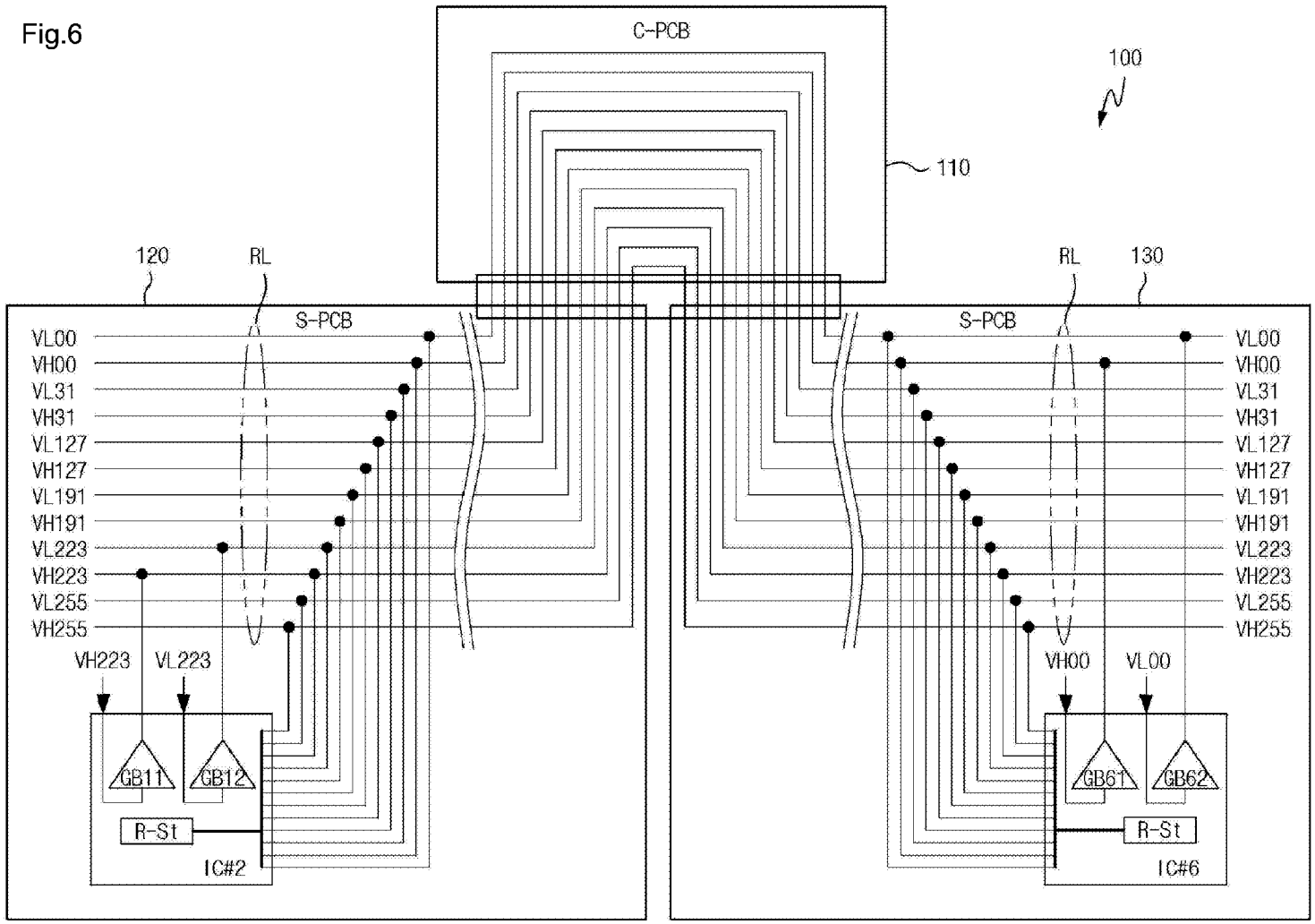
FIG. 6 is a partial arrangement diagram of FIG. 5.

FIG. 5 is an arrangement diagram for explaining a method for routing gamma voltages of a flat panel display according to an embodiment of the present invention, and FIG. 6 is a partial arrangement diagram of FIG. 5.

A flat panel display 100 includes a center printed circuit board (C-PCB) 110 and two source PCBs (S-PCB) 120 and 130.

The C-PCB 110 includes parts for controlling operations performed by the two S-PCBs 120 and 130, and provides a routing path between the S-PCBs 120 and 130. The C-PCB 110 may be electrically connected to the two S-PCBs 120 and 130 through conductive films.

The S-PCB 120 includes three SDICs IC#1 to IC#3.

The SDIC IC#1 includes a gamma buffer GB11 configured to buffer a gamma voltage VH255, a gamma buffer GB12 configured to buffer a gamma voltage VL255, and a resistor string R-ST. The SDIC IC#2 also includes a gamma buffer GB21 configured to buffer a gamma voltage VH223, a gamma buffer GB22 configured to buffer a gamma voltage VL223, and a resistor string R-ST. The SDIC IC#3 includes a gamma buffer GB31 configured to buffer a gamma voltage VH191, a gamma buffer GB32 configured to buffer a gamma voltage VH191, and a resistor string R-ST. The S-PCB 120 includes three SDICs IC#1 to IC#3.

The S-PCB 130 includes three SDICs IC#4 to IC6.

The SDIC IC#4 includes a gamma buffer GB41 configured to buffer a gamma voltage VH127, a gamma buffer GB42 configured to buffer a gamma voltage VL127, and a resistor string R-ST. The SDIC IC#5 also includes a gamma buffer GB51 configured to buffer a gamma voltage VH31, a gamma buffer GB52 configured to buffer a gamma voltage VL31, and a resistor string R-ST. The SDIC IC#6 includes a gamma buffer GB61 configured to buffer a gamma voltage VH00, a gamma buffer GB62 configured to buffer a gamma voltage VH00, and a resistor string R-ST.

Figure 7:
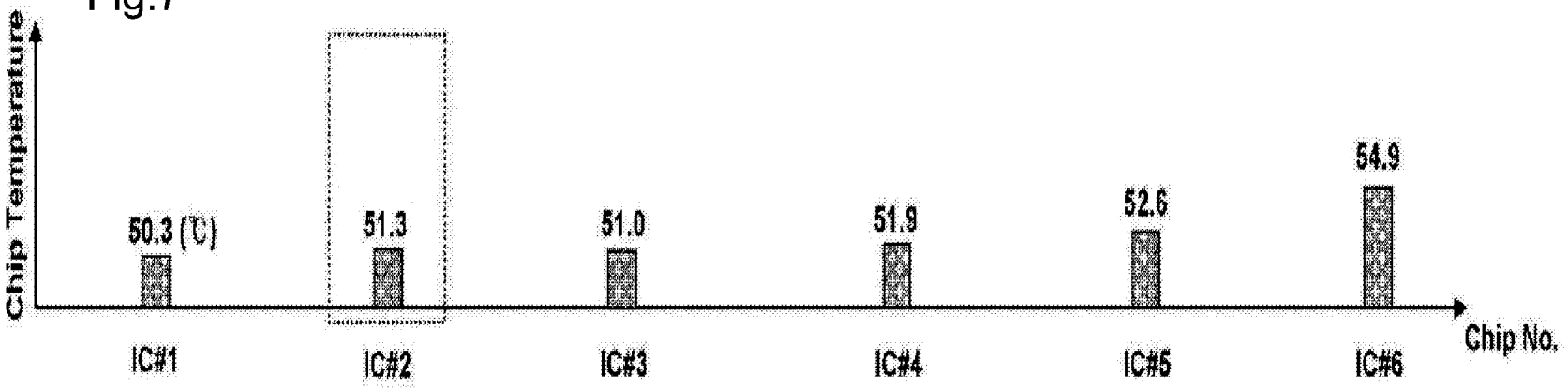
FIG. 7 is a graph illustrating the temperatures of SDICs of FIG. 5.
Figure 8:
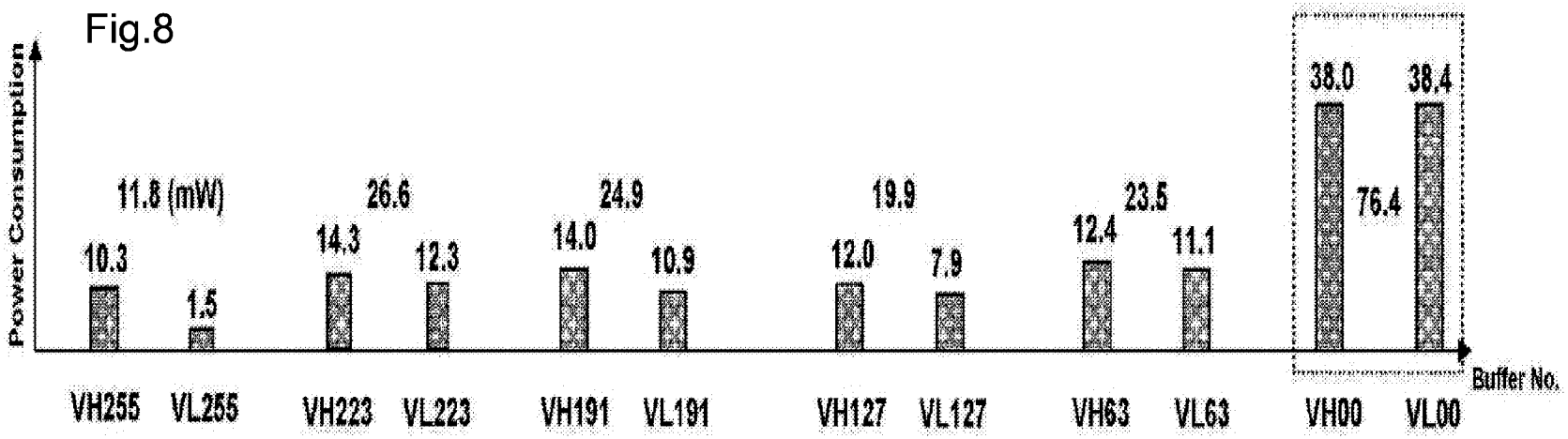
FIG. 8 is a graph illustrating the power consumptions of gamma buffers of FIG. 5.

FIG. 7 is a graph illustrating the temperatures of SDICs of FIG. 5. FIG. 8 is a graph illustrating the power consumptions of the gamma buffers of FIG. 5.

In the embodiment of the present invention based on FIGS. 5 to 8, the gamma voltages VH223 and VL223 are selected instead of gamma voltages VH254 and VL254.

The gamma buffer GB11 has a power consumption of 10.3 mW in response to the gamma voltage VH255, the gamma buffer GB12 has a power consumption of 1.5 mW in response to the gamma voltage VL255, and the sum of the power consumptions is 11.8 mW. The heating value or temperature of the SDIC IC#1 including the gamma buffers GB11 and GB12 is 50.3° C. The temperature of the gamma buffer GB11 is almost equal to the temperature of the gamma buffer GB11 described with reference to FIGS. 1 to 4.

The gamma buffer GB21 has a power consumption of 14.3 mV in response to the gamma voltage VH223, the gamma buffer GB22 has a power consumption of 12.3 mW in response to the gamma voltage VL223, and the sum of the power consumptions is 26.6 mW. The temperature of the SDIC IC#2 including the gamma buffers GB21 and GB22 is 51.3° C.

The temperature of the SDIC IC#2 according to the embodiment of the present invention based on FIGS. 5 to 8 is considerably lower than the temperature (61.9° C.) of the SDIC IC#2 described with reference to FIGS. 1 to 4, to which the gamma voltages VH254 and VL254 are applied.

Furthermore, the SDIC IC#2 according to the embodiment of the present invention based on FIGS. 5 to 8 has a small temperature difference from the other SDICs.

That is, the gamma voltages applied to the gamma buffers GB21 and GB22 the SDIC IC#2 according to the embodiment of the present invention based on FIGS. 5 to 8 are changed from VH254 and VL254 to VH223 and VL223, and the gamma voltages VH223 and VL223 are selected to solve a problem caused by the SDIC IC#2 having the largest heating value.

In the embodiment of the present invention based on FIGS. 5 to 8, the SDIC having the largest heating value may be selected, and the gamma voltages of the gamma buffers of the selected SDIC may be reset to reduce the heating value of the selected SDIC.

Therefore, according to the embodiment of the present invention based on FIGS. 5 to 8, temperature differences among the SDIC s IC#1 to IC#6 may be decreased.

Meanwhile, the gamma voltages routed to the respective SDIC s IC#1 to IC#6 through routing lines RL are applied to the resistor strings R-ST of the respective SDIC s IC#1 to IC#6.

The resistances of the resistor strings R-ST to operate as loads for the respective gamma voltages are varied, and the power consumptions of the gamma buffers are changed depending on the resistances of the resistor strings R-ST operating as loads of the gamma voltages.

Therefore, according to the embodiment of the present invention based on FIGS. 5 to 8, a gamma voltage capable of minimizing power consumed by a gamma buffer is selected in consideration of the gamma voltage buffered by the gamma buffer and the resistance of the resistance string operating as a load for the gamma buffer, and then reflected into the circuit, thereby reducing the heating value of the SDIC having the corresponding gamma buffer mounted therein.

Figure 9:
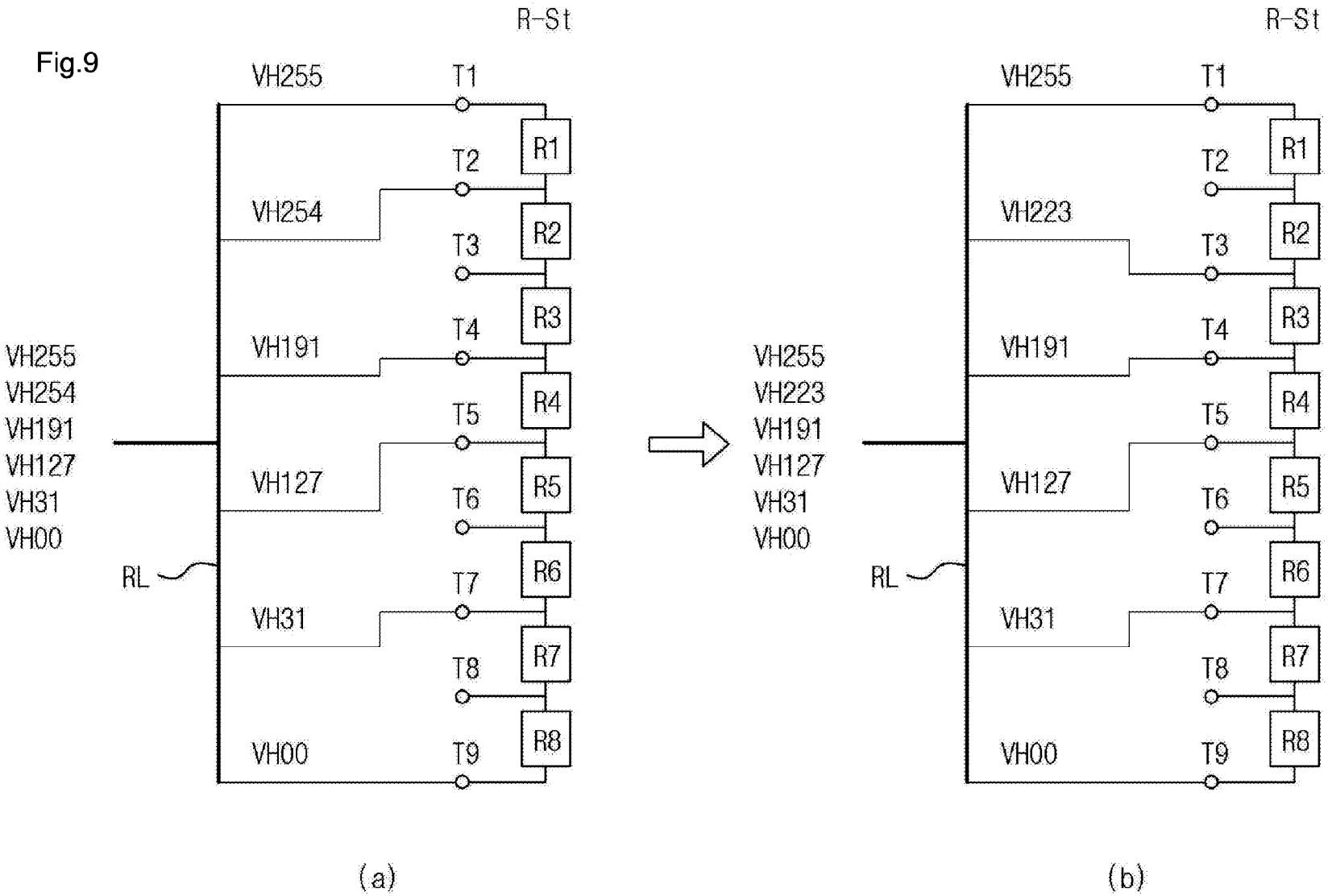
FIGS. 9A and 9B are diagrams for explaining a tap point change state after and before the embodiment of FIG. 5 is applied.

Furthermore, the embodiment of FIGS. 5 to 8 requires tap point change as illustrated in FIGS. 9A and 9B.

FIGS. 9A and 9B illustrate that the resistor string R-ST includes resistors R1 to R8 connected in series, but each of the respective resistors R1 to R8 may include resistors (not illustrated) connected in series to provide a plurality of sub-divided gamma voltages.

That is, in order to reduce the heating value of a gamma buffer whose gamma voltage was changed, a load needs to be controlled. For this operation, the tap point change is required as illustrated in FIGS. 9A and 9B.

More specifically, referring to FIG. 9A, the gamma voltage VH254 is connected to a tap point T2 of the resistor string R-ST. Referring to FIG. 9B, however, the gamma voltage VH223 is connected to a tap point T3 of the resistor string R-ST.

Figure 10:
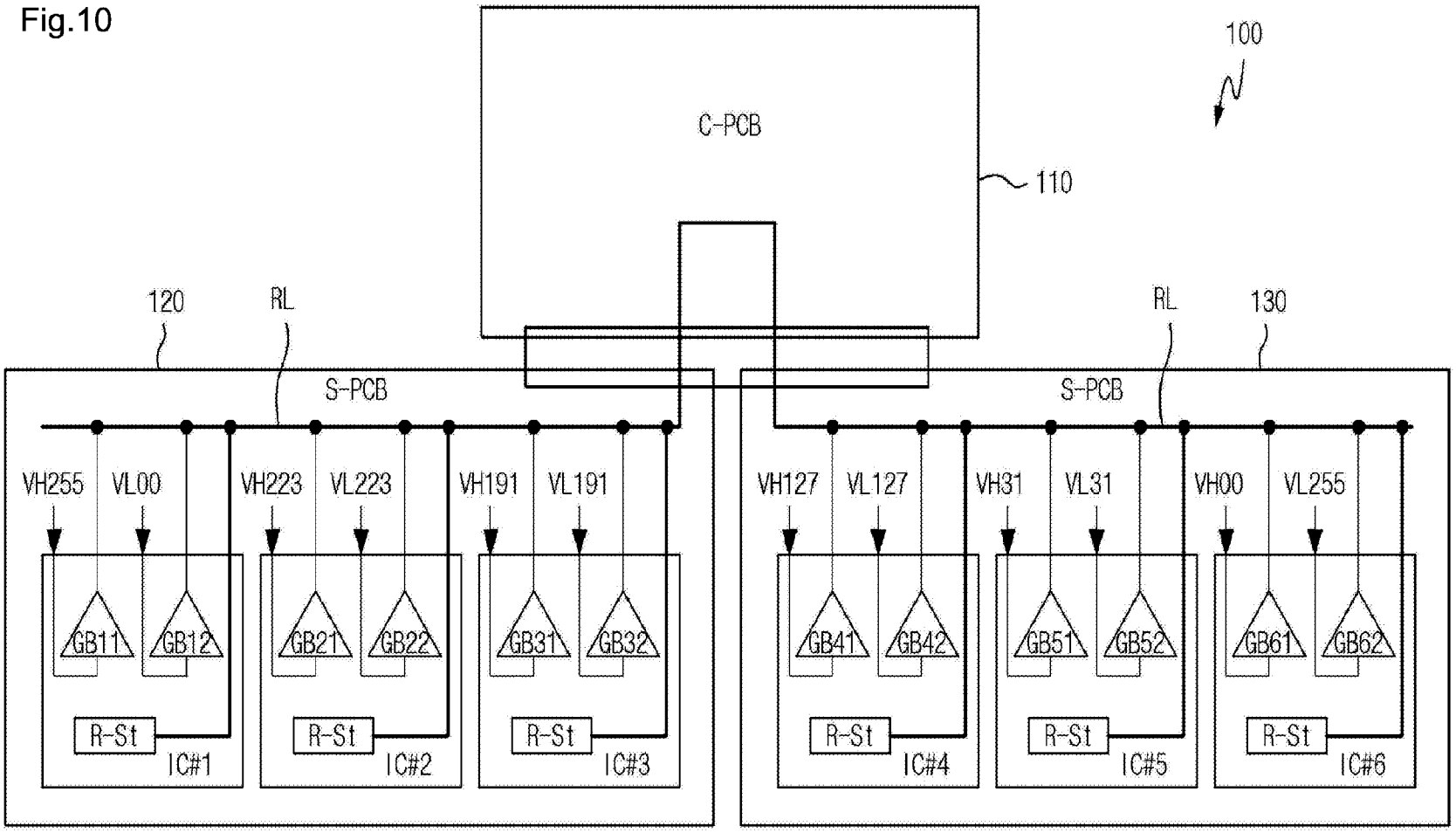
FIG. 10 is an arrangement diagram for explaining a method for routing gamma voltages in a flat panel display according to another embodiment of the present invention.
Figure 11:
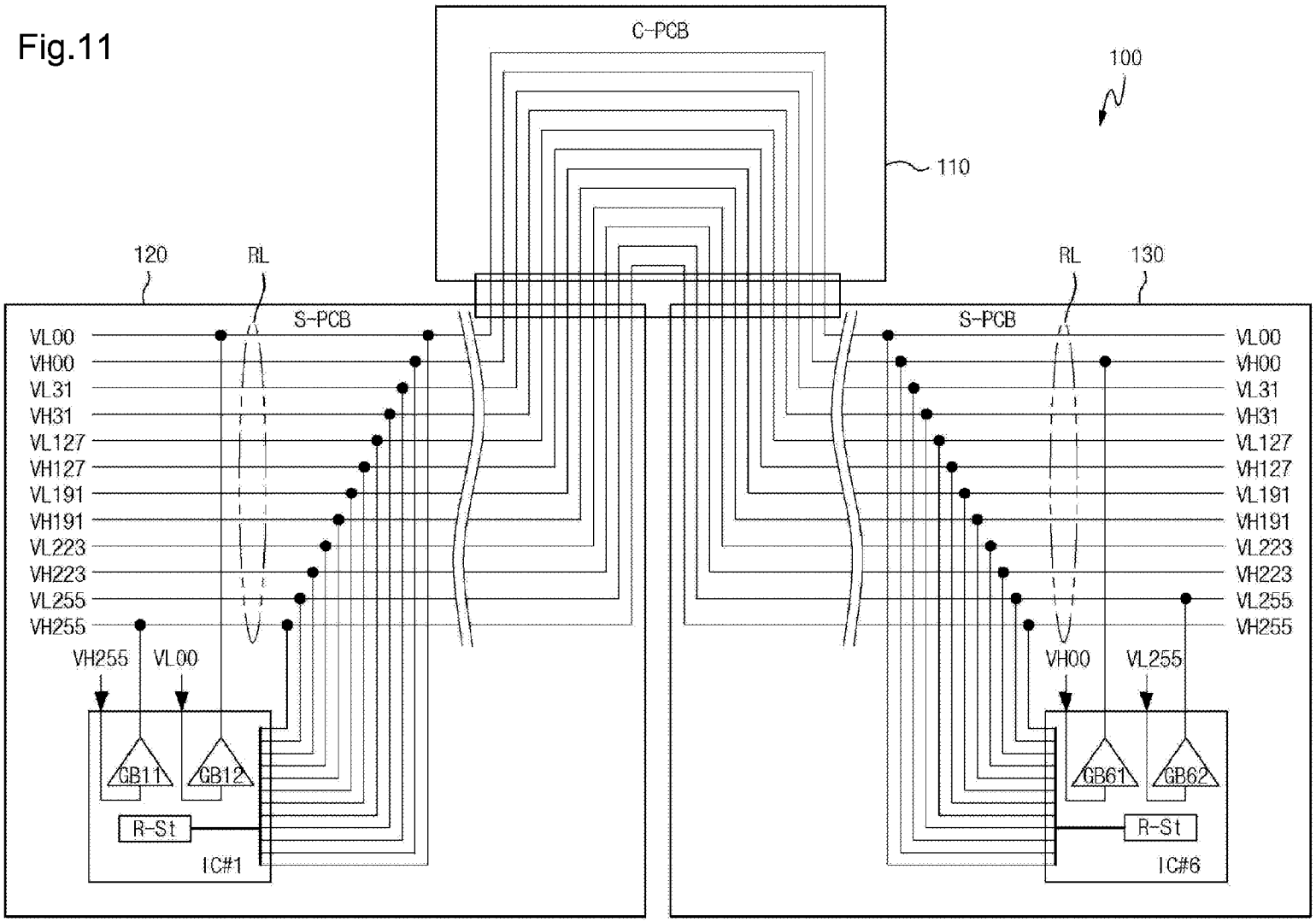
FIG. 11 is a partial detailed arrangement diagram of FIG. 10.

Meanwhile, the present invention may be embodied as illustrated in FIGS. 10 and 11.

FIGS. 10 and 11 illustrate that positions to which the gamma voltages VL00 and VL255 are applied were changed, compared to FIG. 5.

Figure 12:
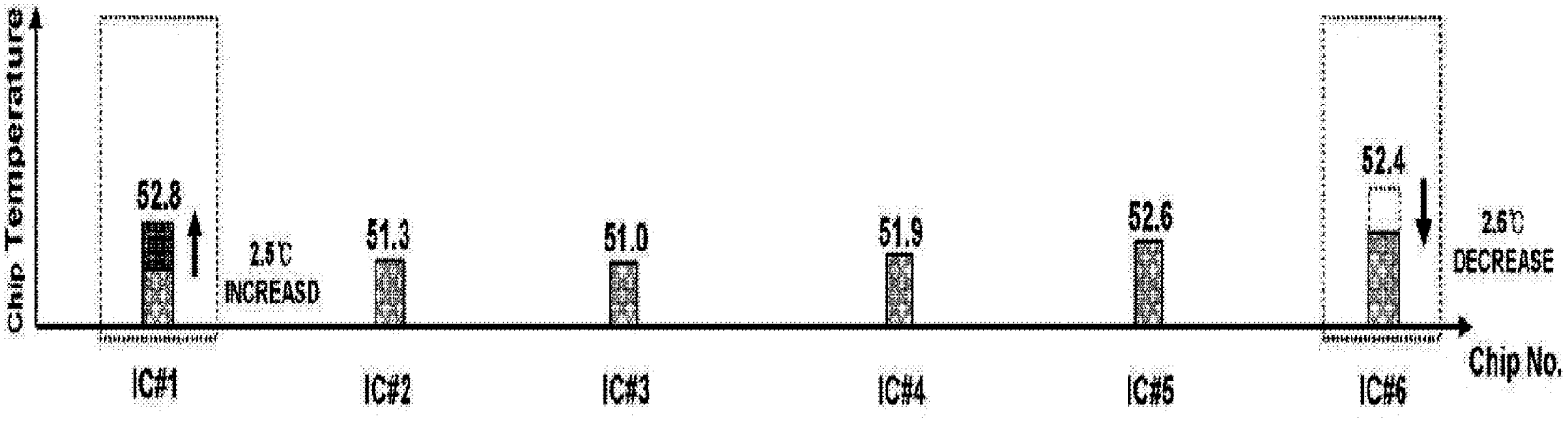
FIG. 12 is a graph illustrating the temperatures of SDICs of FIG. 10.
Figure 13:
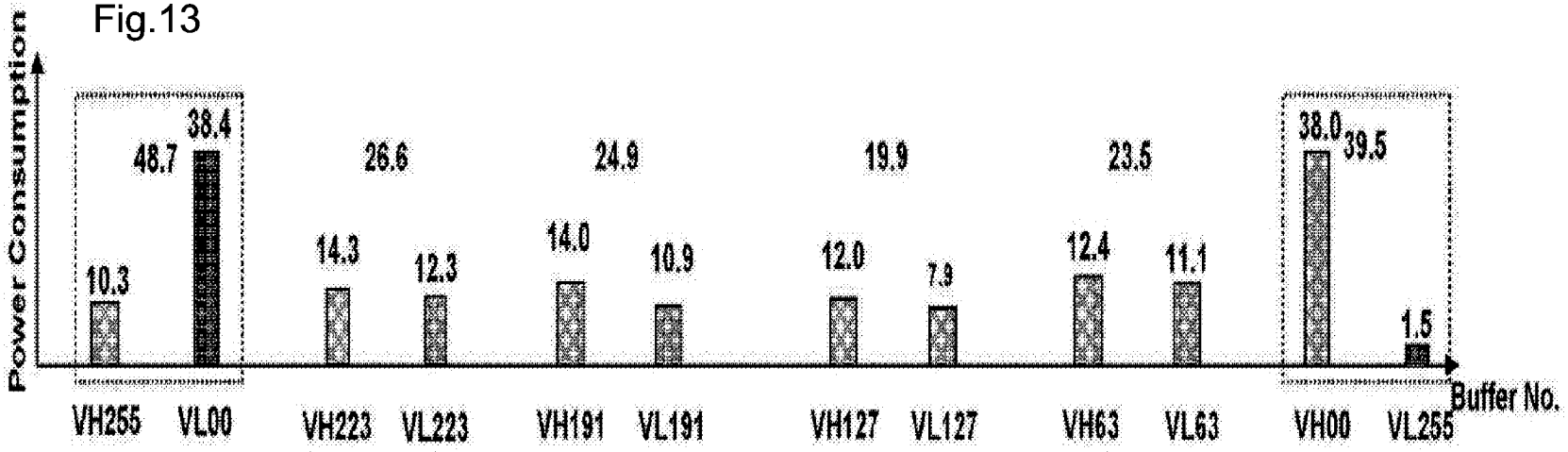
FIG. 13 is a graph illustrating the power consumptions of gamma voltages of FIG. 10.

FIG. 12 is a graph illustrating the temperatures of the SDICs of FIG. 10, and FIG. 13 is a graph illustrating the power consumptions of the gamma voltages of FIG. 10.

That is, in the embodiment of FIGS. 10 and 11, the gamma voltage VL00 is applied to the gamma buffer GB12 of the SDIC IC#1, and the gamma voltage VL255 is applied to the gamma buffer GB62 of the SDIC IC#6.

Accordingly, the gamma buffer GB12 buffers the gamma voltage VL00 and provides the buffered voltage to the respective SDICs through the routing lines RL, and the gamma buffer GB62 buffers the gamma voltage VL255 and provides the buffered voltage to the respective SDICs through the routing lines RL.

In the embodiment of FIGS. 5 to 8, the gamma buffer GB12 of the SDIC IC#1 has the smallest power consumption, and the gamma buffer GB22 of the SDIC IC#6 has the largest power consumption.

Therefore, in the embodiment of FIGS. 10 to 13, the position of the gamma voltage VL00 applied to the gamma buffer GB62 having the largest power consumption and the position of the gamma voltage VL255 applied to the gamma buffer GB12 having the smallest power consumption are exchanged, in order to distribute the power consumptions and uniformize the heating values among the SDICs.

In the embodiment of FIGS. 10 to 13, the gamma voltage VL00 applied to the SDIC IC#6 having the largest power consumption is replaced with the gamma voltage VL255 applied to the gamma buffer GB12 having the smallest power consumption, thereby reducing the heating value of the SDIC IC#6.

Furthermore, according to the embodiment of FIGS. 10 to 13, the temperature differences among the SDICs IC#1 to IC#6 may be uniformized.

Figure 14:
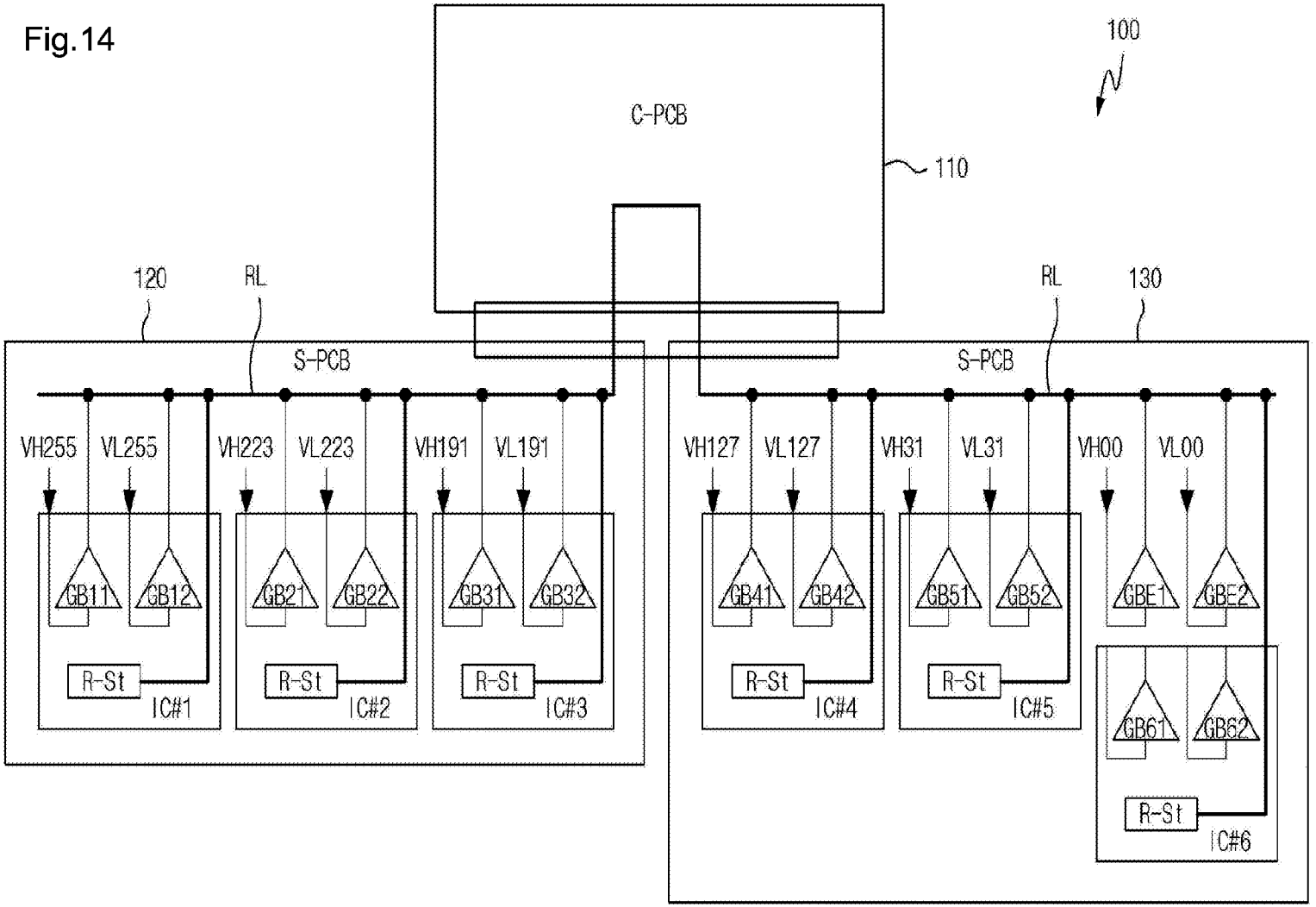
FIG. 14 is an arrangement diagram for explaining a method for routing gamma voltages in a flat panel display according to another embodiment of the present invention.
Figure 15:
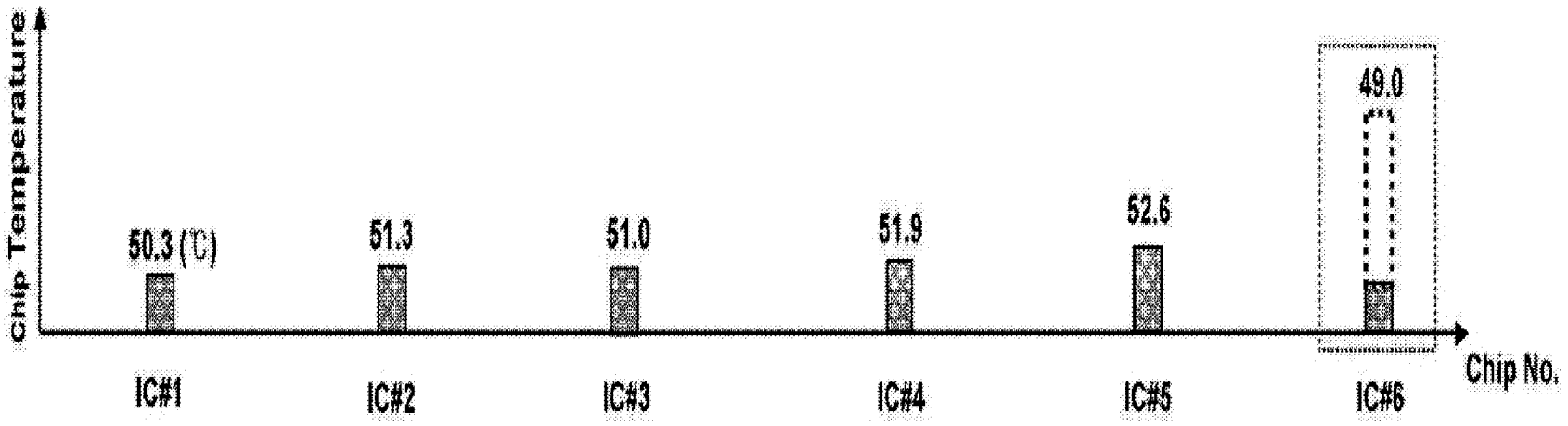
FIG. 15 is a graph illustrating the temperatures of SDICs of FIG. 14.
Figure 16:
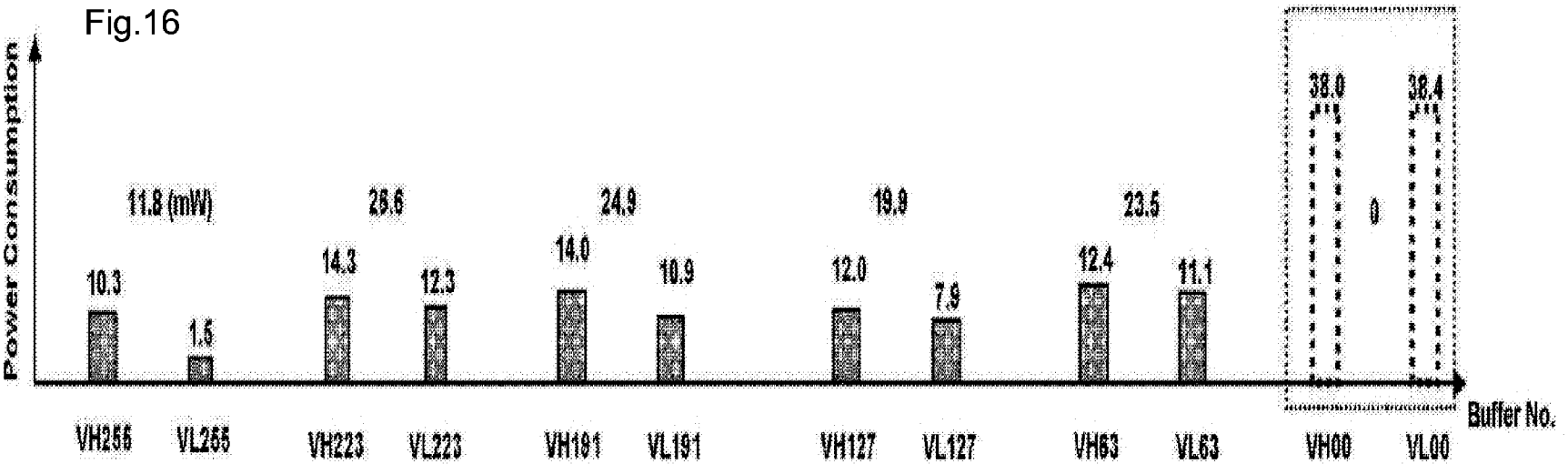
FIG. 16 is a graph illustrating the power consumptions of gamma buffers of FIG. 14.

Meanwhile, the present invention may be embodied as illustrated in FIG. 14. FIG. 15 is a graph illustrating the temperatures of SDICs of FIG. 14, and FIG. 16 is a graph illustrating the power consumptions of gamma buffers of FIG. 14.

Referring to FIG. 14, the flat panel display 100 includes a sub-PCB 130 having external gamma buffers GBE1 and GBE2 mounted therein.

The external gamma buffers GBE1 and GBE2 are configured to receive the gamma voltage VH00 and VH00 through input terminals thereof.

According to the embodiment of the present invention, a gamma buffer having a high heating value or gamma buffers included in an SDIC having a high heating value are selected and floated, and input of a gamma voltage for the selected gamma buffer and connection between the selected gamma buffer and a routing line RL are changed to the external gamma buffers GBE1 and GBE2.

FIG. 14 illustrates that the gamma buffers GB61 and GB62 included in the SDIC IC#6 having a high heating value are floated and the gamma voltages VH00 and VL00 are routed through the external gamma buffers GBE1 and GBE2.

The present invention may be applied to one gamma buffer having a high heating value or two or more gamma buffers having a high heating value, which are included in different SDIC s, unlike the embodiment of FIG. 14.

Furthermore, the number of external gamma buffers may be set to the same number as the number of gamma buffers to change routing.

Furthermore, when necessary, the gamma buffers to change routing may be selected in order of heating value, by the same number as the number of external gamma buffers.

The external gamma buffers may be mounted on the same PCB as the SDIC in which the selected gamma buffer is mounted.

According to the configuration of FIG. 14, the temperature of the SDIC IC#6 may be decreased, and the gamma buffers GB61 and GB62 inside the SDIC IC#6 may not consume power.

Figure 17:
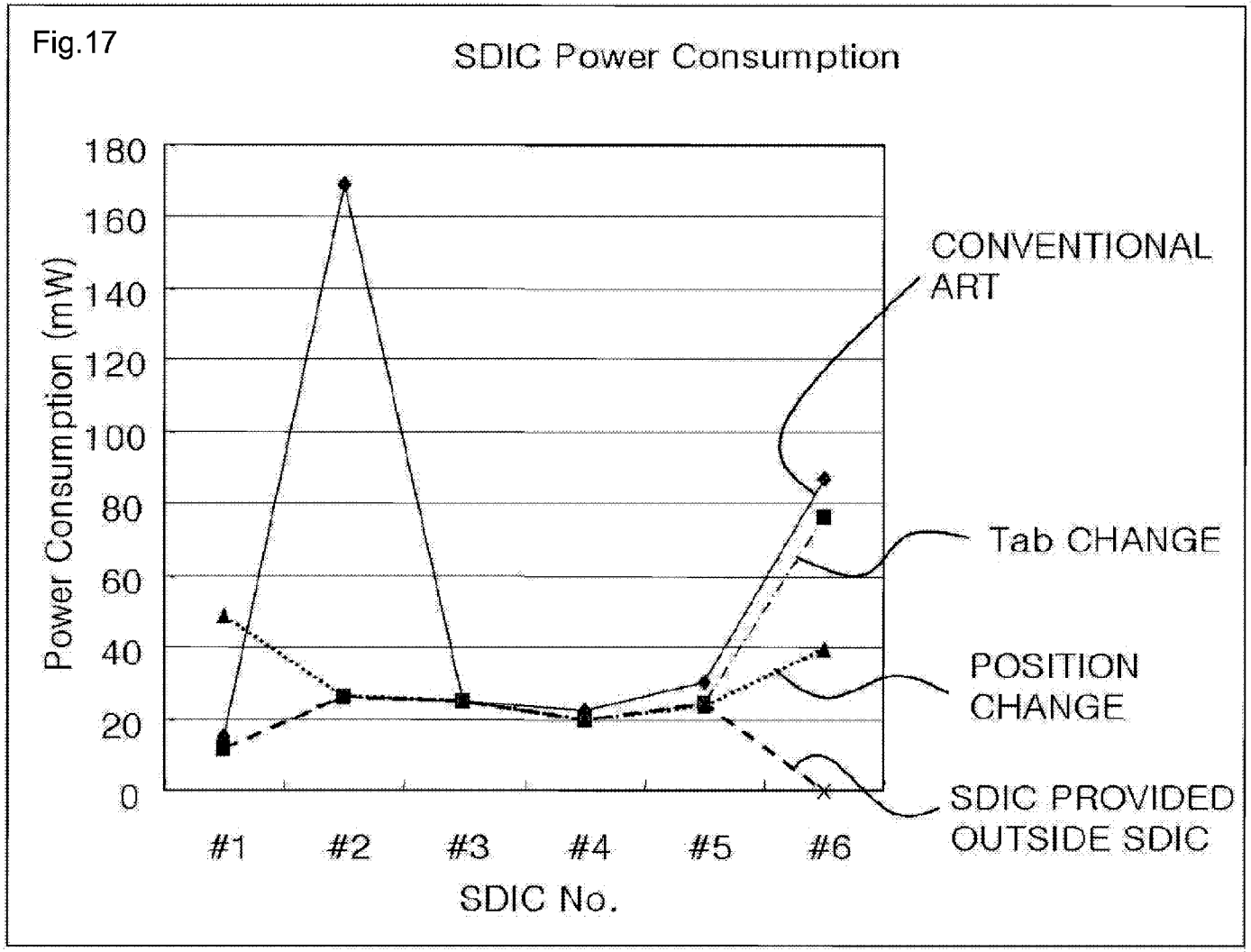
FIG. 17 is a graph illustrating the power consumptions of the SDICs according to the embodiments of the present invention.
Figure 18:
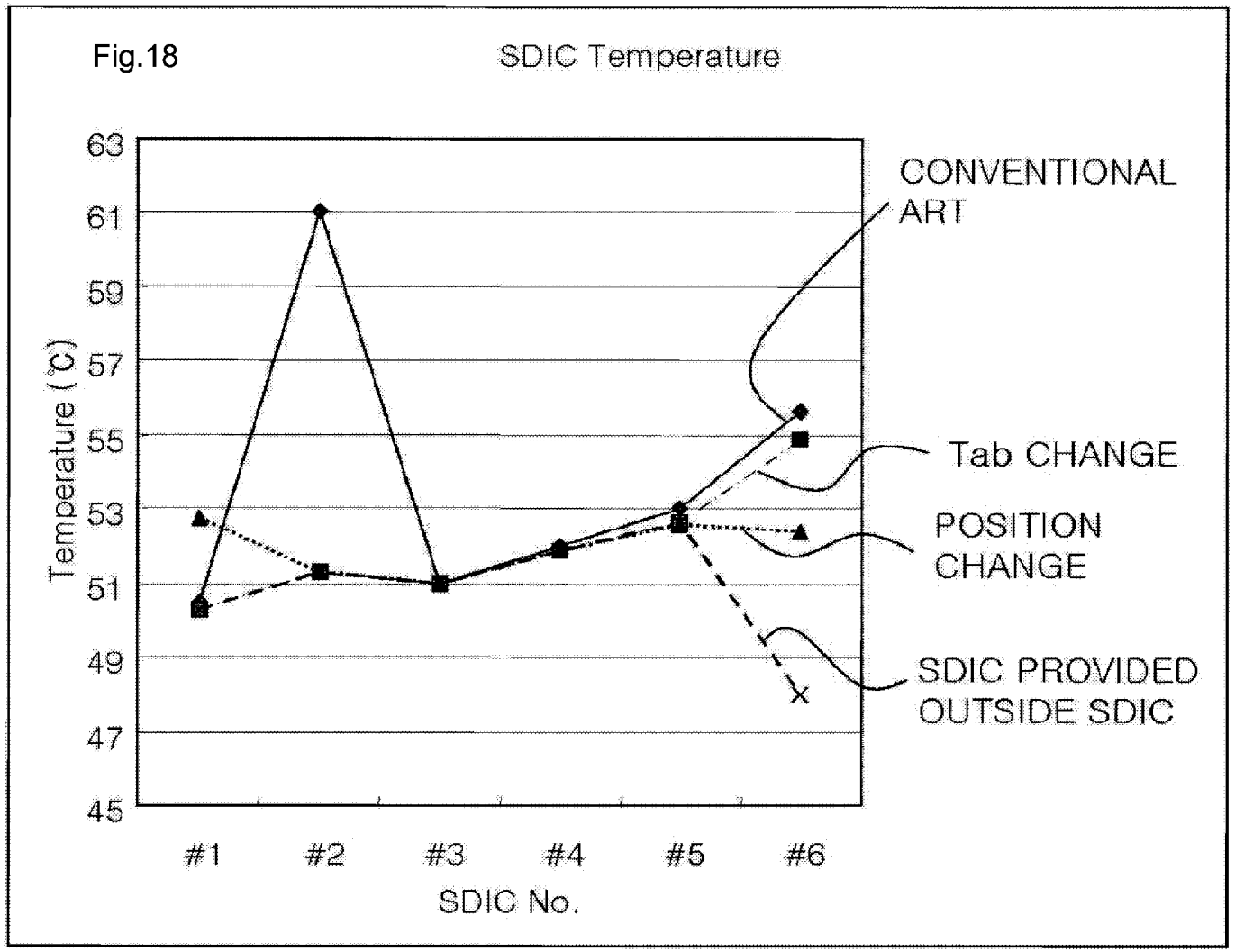
FIG. 18 is a graph comparatively illustrating the temperatures of the SDICs according to the embodiments of the present invention.

FIG. 17 is a graph illustrating the power consumptions of the SDICs caused by the power consumption of the gamma buffers, and FIG. 18 is a graph comparatively illustrating the temperatures of the SDICs caused by the power consumptions of the gamma buffers.

Referring to FIGS. 17 and 18, the power consumptions of the gamma buffers may be calculated to estimate the temperatures of the SDICs having the gamma buffers mounted therein. Based on the estimated temperatures, the gamma voltages may be changed, and the positions of the gamma voltages may be changed. Accordingly, the temperature differences among the SDICs may be reduced.

So far, the flat panel display according to the embodiments of the present invention has been described with reference to the accompanying drawings. A method for routing gamma voltages may also be described by referring to the detailed descriptions with reference to the accompanying drawings.

According to the embodiments of the present invention, the temperatures of the SDICs mounted in the flat panel display may be reduced, and the temperature differences among the SDICs maybe minimized to improve the lifetime and reliability of the flat panel display.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A method for routing gamma voltages in a flat panel display that includes a plurality of source driver integrated circuits (SDICs) each having a plurality of gamma buffers, the method comprising:

forming routing lines to route a plurality of gamma voltages;

connecting the routing lines to output terminals of the gamma buffers;

applying the reset gamma voltage to the gamma buffer of selected SDIC after selecting the SDIC in which the gamma voltage is required to be reset in consideration of heating values of the SDICs, and changing connection between a routing line corresponding to the selected gamma buffer and a tap point of a resistor string of the SDIC such that the connection corresponds to the reset gamma voltage.

2. The method according to claim 1, wherein the SDIC in which the gamma voltage is required to be reset is selected as an SDIC having the highest heating value.

3. A method for routing gamma voltages in a flat panel display that includes a plurality of SDICs each having a plurality of gamma buffers, the method comprising:

forming routing lines to route a plurality of gamma voltages; and exchanging positions to which a pair of selected gamma voltages are applied and transmitting the pair of selected gamma voltages to the routing lines at the exchanged positions after selecting the pair of gamma voltages to be applied to different SDICs in consideration of heating values of the gamma buffers.

4. The method according to claim 3, wherein the pair of selected gamma voltages are applied to a gamma buffer having the highest heating value and a gamma buffer having the smallest heating value, respectively.

5. A method for routing gamma voltages in a flat panel display that includes a plurality of SDICs each having a plurality of gamma buffers, the method comprising:

mounting one or more external gamma buffers outside the plurality of SDICs;

forming routing lines to route a plurality of gamma voltages;

changing input of the gamma voltage for a selected gamma buffer and connection between the selected gamma buffer and the routing line to the external gamma buffers after selecting one or more the gamma buffers in consideration of heating values of the gamma buffers; and floating the selected gamma buffers.

6. The method according to claim 5, wherein the number of external gamma buffers is set to the same as the number of gamma buffers included in one SDIC, the gamma buffers included in an SDIC having the highest heating value are selected, and input of the gamma voltage for the selected gamma buffers and connection between the gamma buffers and the routing lines are changed to the external gamma buffers.

7. The method according to claim 5, wherein one or more gamma buffers are selected in order of heating value, by the same number as the number of external gamma buffers.

8. The method according to claim 5, wherein the external gamma buffer is mounted on the same PCB as the selected gamma buffer.

* * * * *